United States Patent [19]

Huether et al.

[11] Patent Number: 4,894,086

[45] Date of Patent: Jan. 16, 1990

[54] METHOD OF PRODUCING DISPERSION HARDENED METAL ALLOYS

[75] Inventors: Werner Huether, Karlsfeld; Wolfgang Betz, Gauting; Gerhard Andrees, Munich, all of Fed. Rep. of Germany

[73] Assignee: MTU- Motoren-und Turbinen-Union Munchen GmbH, Munich, Fed. Rep. of Germany

[21] Appl. No.: 190,993

[22] Filed: May 6, 1988

[30] Foreign Application Priority Data

May 13, 1987 [DE] Fed. Rep. of Germany ..... 3715979

[51] Int. Cl.[4] ..... B22F 3/12; B22F 5/00

[52] U.S. Cl. ..... 75/0.5 A; 419/40; 419/46; 419/66; 428/14

[58] Field of Search ..... 75/0.5 A; 428/14; 419/62, 66, 46, 40

[56] References Cited

U.S. PATENT DOCUMENTS

| | | | |
|---|---|---|---|
| 3,617,253 | 11/1971 | Amiet | 75/0.5 A |
| 3,997,331 | 12/1976 | Tither | 75/0.5 A |
| 4,072,501 | 2/1978 | Quinby | 75/0.5 A |
| 4,615,736 | 10/1986 | Armor et al. | 419/62 |
| 4,728,359 | 3/1988 | Huther et al. | 75/0.5 A |
| 4,731,110 | 3/1988 | Kopatz et al. | 75/0.5 A |

*Primary Examiner*—Upendra Roy

*Attorney, Agent, or Firm*—Roberts, Spiecens & Cohen

[57] ABSTRACT

A method of producing dispersion hardened metal alloys which incorporate highly reactive metals or their alloys whose oxides are not adapted to be easily reduced. According to the method, the highly reactive metals of their alloys are added as powder particles to a solution of a salt of a reducible metal which is to form a metallic matrix in which the reactive metals or their alloys are to be integrated, after which the solution is atomized to form particles from which the solvent is removed to yield the final product of the metal matrix with the highly reactive metals or their alloys integrated therein as a second phase.

16 Claims, No Drawings

METHOD OF PRODUCING DISPERSION HARDENED METAL ALLOYS

FIELD OF THE INVENTION

The invention relates to a method for the production of dispersion hardened metal alloys for structural parts of complicated shape which are resistant to high temperatures and in which particles of a second phase are integrated into a metallic matrix.

In particular the invention relates to a method for producing dispersion hardened metal alloys containing elements which are not readily reducible.

BACKGROUND

In our earlier U.S. Pat. No. 4,728,359, we have disclosed a method for the production of dispersion hardened metal alloys in which a colloidal suspension is formed of the particles of the second phase in a salt solution of the metal alloys, the particles of the second phase being non-reactive with the metals and their salt solutions, and to the colloidal suspension a deglomerating agent is optionally added. The solution is then sprayed to form atomized particles, and after removal of the solvent, the atomized particles are reduced to form powders of the metal matrix with the particles of the second phase integrated therein.

Metal alloys, particularly superalloys for structural parts of complicated shape which are resistant to high temperatures, such as turbine blades or similarly complicated shaped bodies, frequently contain highly reactive elements such as titanium, chromium, aluminum and the like. Upon the conversion of such metal alloys into a metal powder, according to the method in the above patent, mixed oxides are produced which are difficult if not impossible to reduce to the metal state. The oxides are produced upon the removal of the solvent or of the water of crystallization.

SUMMARY OF THE INVENTION

An object of the invention is so to provide improvements in the method of our earlier patent so that the target alloys can be produced in metal powder form even though they contain highly reactive elements.

In accordance with the invention, the starting materials for the solution are one or more salts of a reducible metal and, as the second phase, powder particles of metals or their alloys whose salts and oxides cannot be subjected directly to a reduction process.

The method of the invention improves and extends the field of use of the method of our earlier patent.

In addition to the above, non-reactive dispersants, particularly oxidic dispersants, can be introduced in the form of particles into the suspension in addition to the metallic particles. Thereby the effect of the dispersion hardening can be substantially increased. This is particularly advantageous if it is desired to prevent grain growth, particularly upon sintering, and to restrain the development of close subgrain boundaries in the shaped bodies under high load, particularly upon thermal expansion and creep.

By affecting a heat treatment step according to a particular temperature-time program before or after the compacting of the metal powder to form the shaped alloy article, the metal particles can be uniformly diffused into the matrix even if they are oxidized on their surfaces.

Thus alloys can be formed as metal powders which also contain the reactive elements. Metal salts or mixtures of salts of reducible metals are used as the starting materials for the solution. In this way, a suspension of fine powder particles of the highly reactive elements or suitable prealloys with said elements are produced in the suspension, optionally with addition of a deglomeration agent. After spraying, drying and reducing this mixture, at most a thin surface layer of the metal powders is oxidized. The remaining metal can be uniformly distributed to the desired extent in the metallic matrix by diffusion treatment before or after the compacting of the metal powder. If a mixture of salt solutions of reactive and non-reactive metals is used, powders and sintered shaped bodies which contain, in addition, a uniform distribution of very fine oxide particles can be produced therefrom. The particle size and distribution depends on the sintering conditions for forming the shaped body. In this way, one can obtain superalloys of optimal composition with different dispersant concentrations for the strengthening of the matrix.

Modifications of the disclosed embodiments can, of course, be effected without going beyond the scope of the invention. For example, instead of the colloidal suspension, a non-colloidal particle distribution in the solution can be used as the suspension.

DETAILED DESCRIPTION OF PREFERRED EMBODIMENT

The invention will be described with reference to the example which follows hereafter in which preferred embodiments of the method are set forth.

EXAMPLE

A salt solution of a metal alloy is formed by dissolving the metal alloy in hydrochloric acid. The metal alloy is intended to form the matrix of a metallic powder suitable for the production of s dispersion hardened metal alloy containing highly reactive metal particles which cannot be directly subjected to a reduction treatment.

The metal alloy is a nickel chromium alloy in which the nickel and chromium are in a ratio of 80:20. Within the scope in the invention, it is essential that metal salts or mixtures of salts or reducible metals be used as the starting material.

To the salt solution are added, as a second phase, particles of metals which could not be produced by reduction from their oxides, such as aluminum, titanium, chromium or alloys thereof. The alloys may be AlTi, $Al_2Ti$ or non-stoichiometric mixtures thereof. Alloys of reducible and non-reducible metals may be added as particles to the salt solution to form a suspension, for instance NiAl or NiAlTi or NiCr. The amount of added metal particles depends on the content desired in the final alloy. For superalloys, up to 10% by weight of metal particles of Al and Ti can be added whereas for chromium up to 20% by weight can be added. The metal particles can be produced in customary manner, for instance, by gas atomization, rotational atomization, ultrasonic atomization, discharge processes of the like. The size of the metal particle is selected so that diffusion up to the homogenization of the compacted material is reasonably short and a suitable particle size is 0.01 $\mu$m. Hence, even with slight oxidation of the metal particles, a sufficient amount of non-oxidzed metal remains. The thickness of the oxide layer is of the order of nm.

Oxide particles of $Y_2O_3$ or $ThO_2$ of a size of between about 0.01 μm to about 0.1 um can also be admixed in the salt solution of the metal alloy containing the metal particles. The oxide particles can be added to the solution in an amount such that the oxide particles represent up to 75% by volume of the metal alloy.

In order to prevent agglomeration of the metal and oxide particles in the solution, the particles are separated by adsorption of similarly charged molecules, i.e. electrically charged particles of the same polarity, and held in suspension in the solution. For this purpose, deglomerating agents such as trisodium orthophosphate or aluminum nitrate are added to the solution.

The colloidal solution or slip thus produced is then atomized in a trickle tower and is either directly transferred into a reaction chamber or is first dried and converted in another reaction vessel into metal powder in which the metal particles and oxide inclusions are dispersed uniformly therein.

The metal powder obtained in this manner can then be worked by known methods of powder metallurgy to form compact bodies of desired shape, for instance, by injection molding, extrusion, extrusion molding, sintering, cold isostatic pressing or hot isostatic pressing. The selection of the method of compacting depends, in particular, on the purpose of use of the final product, namely as a high-temperature structural part. The method determines the shape and size of the final product and provides the desired mechanical and other properties as well as the desired density and surface finish.

Modifications of the disclosed method can be effected without departing from the scope of the invention, provided that the same properties of the powder or the structural parts are obtained and the method of particle separation in the colloidal solution is employed.

The invention is also not limited to the metal alloy disclosed in the Example and other materials, particularly other alloys, can form the metal matrix. The solvents for the metallic alloys to form the salt solutions, the construction of the atomizing equipment and its operating parameters as well as the powder reduction of the atomized particles into metal are known per se.

As seen from the above, the invention is characterized by the incorporation into the suspension of highly reactive metals in particulate form so that the metals will be integrated into the alloy product. These highly reactive metals could not themselves form part of the alloy solution as it is not feasible to reduce the resulting oxide particles which would be produced. Hence, the invention provides the way in which the highly reactive non-reducible metals and their alloys can be integrated into the produced powders and the structural parts produced therefrom.

What is claimed is:

1. In a method of producing a dispersion hardened metal alloy for structural parts of complicated shape which are resistant to high temperatures, in which particles of a second phase are integrated into a metallic matrix by forming a colloidal suspension of said particles in a salt solution of the metal alloy, the particles of the second phase being non reactive with the metals and their salt solution, adding a deglomerating agent to the solution, spraying the solution, to form atomized particles thereof, removing the solvent of the solution and reducing the atomized particles to form powders of the metal matrix with said particles of the second phase integrated therein, the improvement comprising forming integrated dispersed powders of metal matrix and reactive metals using as starting materials for said solution a salt of a reducible metal and admixing as the second phase to the salt solution, powder particles of metals or their alloys whose salts or oxides cannot be subjected directly to a reduction process whereby highly reactive metals are alloys whose salts and oxides are non reducible and integrated into the produced powders.

2. The improvement as claimed in claim 1 wherein a mixture of reducible metal salts of form said alloy solution.

3. The improvement as claimed in claim 1 wherein the metal powder particles include surface oxidized metal particles.

4. The improvement as claimed in claim 1 comprising uniformly distributing the particles of the second phase into the metal matrix by a diffusion heat treatment.

5. The improvement as claimed in claim 1 wherein said highly reactive metal powder particles are titanium, chromium, aluminum or alloys thereof.

6. The improvement as claimed in claim 2 comprising further adding to said solution non-reactive dispersants.

7. The improvement as claimed in claim 4 further comprising forming structural parts from said powders of the metal matrix in which the metal particles of the second phase are integrated by compacting said powders.

8. The improvement as claimed in claim 6 wherein said non-reactive dispersants are oxidic.

9. The improvement as claimed in claim 6 comprising further adding to said solution a salt of a reactive metal which forms a metal oxide after solvent removal and reduction.

10. the improvement as claimed in claim 7 wherein said metal particles are uniformly distributed into the metal matrix by said heat treatment prior to said compacting.

11. The improvement as claimed in claim 7 wherein said metal particles are uniformly distributed into the metal matrix by said heat treatment subsequent to said compacting.

12. The improvement as claimed in claim 9 wherein the reactive metal is titanium, chromium or aluminum.

13. A method of producing dispersion hardened metal alloys having a metal matrix and metal particles integrated into the matrix, said method comprising forming a solution of a reducible salt of a metal, suspending in said solution, as a second phase, particles of a metal or alloys thereof whose oxides and salts are non-reducible, forming atomized particles of the salt solution including the incorporated second phase and reducing the thus atomized particles to form powders of the metal matrix with said particles integrated therein as the second phase.

14. A method as claimed in claim 13 wherein said metal of the second phase is titanium, chromium, aluminum, or alloys thereof.

15. A method as claimed in claim 13 comprising heat treating the powders obtained after reduction to effect uniform distribution of the particles of the second phase in the metal matrix.

16. A method as claimed in claim 14 comprising adding to said solution non-reactive oxide dispersants.

* * * * *